United States Patent [19]

Kirchmeier

[11] Patent Number: 4,699,206

[45] Date of Patent: Oct. 13, 1987

[54] ROTARY HEAT EXCHANGER

[76] Inventor: Hans Kirchmeier, Kleinheide 21, D-5067 Kürten 2, Fed. Rep. of Germany

[21] Appl. No.: 783,472

[22] Filed: Oct. 3, 1985

[30] Foreign Application Priority Data

Jun. 25, 1985 [DE] Fed. Rep. of Germany ... 8518384[U]

[51] Int. Cl.[4] ..... F28D 19/00

[52] U.S. Cl. ..... 165/7; 165/8; 165/10

[58] Field of Search ..... 165/7, 8, 10

[56] References Cited

U.S. PATENT DOCUMENTS

| | | | |
|---|---|---|---|
| 1,560,271 | 11/1925 | Lynger | 165/8 |
| 1,843,252 | 2/1932 | Toensfeldt | 165/7 |
| 3,456,718 | 7/1969 | DeFries | 165/10 |

*Primary Examiner*—Albert W. Davis, Jr.

*Attorney, Agent, or Firm*—Gifford, Groh, VanOphem, Sheridan, Sprinkle and Dolgorukov

[57] ABSTRACT

A rotary heat exchanger for heat exchange between at least two gaseous media comprises an annular heat transfer member rotating in a housing. A stationary partitioning wall is provided within the heat transfer member, thereby defining therein first and second semi-circular chambers communicating with inlet openings in the housing. Outlet diffuser chambers are provided outside the heat transfer member and increase in width towards their outlet ends for the discharge from the apparatus. The partitioning wall is provided with a screening wall portion at at least one edge adjoining the inside surface of heat transfer member. The partitioning wall may be of a heat-insulating construction, while the heat exchanger may be combined with a fan assembly disposed in parallel relationship with the heat exchanger so the arrangement can be operated in a heat exchange mode or a pure fan blowing mode, being controllable by flow control flaps.

5 Claims, 8 Drawing Figures

Fig. 1
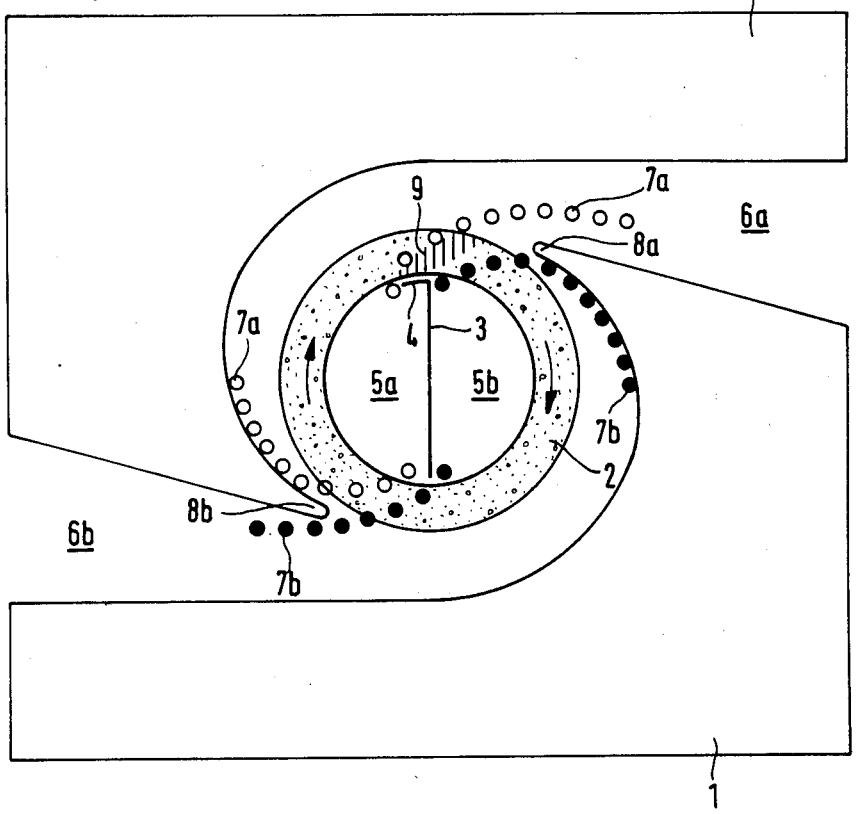
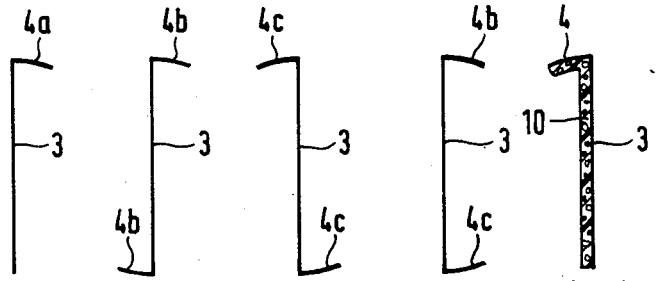
Fig. 2a Fig. 2b Fig. 2c Fig. 2d Fig. 2e

ROTARY HEAT EXCHANGER

BACKGROUND OF THE INVENTION

The present invention relates to heat exchangers and more particularly to a rotary heat exchanger for heat exchange between at least two gaseous media.

In one form of a rotary heat exchanger, as disclosed in German patent specification No. 1 551 457, the heat exchanger comprises an annular heat transfer member which is disposed rotatably in a housing of the apparatus. The heat transfer member may comprise a fibre material forming a three-dimensional lattice structure. Provided in the interior of the heat transfer member and subdividing same into two semicircular chambers is a stationary partitioning wall. The housing of the heat exchanger has two inlet ports or openings which respectively communicate with the semicircular chambers defined in the interior of the heat transfer member. The heat exchanger further has two outlet diffuser chambers which are disposed in mutually opposite relationship, outside the heat transfer member, with the width of each outlet chamber increasing from its point at which it defines a narrow gap with the heat transfer member, towards the actual outlet of the respective outlet chamber. That heat exchanger is used in particular for heat exchange purposes between a feed air flow and an exhaust or outlet air flow in buildings in order to make energy savings by the recovery of heat from the exhaust air flow. The rotary heat transfer member also acts at the same time as a radial flow fan or blower both for the feed air flow and for the exhaust air flow, so that in most cases it is possible to eliminate additional fans for generating the appropriate air flows. The material used for the heat transfer member, besides fibre material, is generally open-pore foam material, in an annular form.

It is found that the degree of separation between the two flows of air, or other gaseous media in a heat exchange relationship, as well as the degree of efficiency of the above-indicated heat exchanger are good, in other words, there is only a slight degree of mixing as between the feed air and the exhaust air, of for example around 15%, and the temperature difference between the two flows, after passing through the heat exchanger, is only a few degrees Centigrade. However, there is a desire further to improve the values which have been achieved hitherto in those respects, in the interests of maximising energy saving and minimising mixing of the two flows involved.

SUMMARY OF THE INVENTION

An object of the present invention is to provide a rotary heat exchanger which affords an enhanced level of heat exchange efficiency.

Another object of the invention is to provide a rotary-type heat exchanger which achieves a very low degree of mixing as between the intake and outlet gaseous media.

A further object of the invention is to provide a rotary heat exchanger so constructed as to permit the exchanger to be used in a wide range of practical situations of use.

Still another object of the present invention is to provide a rotary heat exchanger adapted to maintain a temperature difference between respective sides of the heat exchanger assembly.

Yet another object of the present invention is to provide a heat exchanger which is more versatile in regard to the modes of operation thereof.

A still further object of the invention is to provide a heat exchanger-fan assembly with enhanced heat-exchange efficiency and the capability of operating in a heat exchange mode or a pure fan mode while being of a compact design.

To attain those and other objects, the present invention provides a rotary heat exchanger for heat exchange between first and second gaseous media, comprising a housing having first and second inlet openings, with an annular heat transfer member disposed rotatably in the housing and comprising for example a fibre material forming a three-dimensional lattice structure. Provided in the interior of the heat transfer member is a partitioning wall means which is stationary, that is to say, non-rotatable, with respect to the housing and which divides the interior of the heat transfer member into first and second semicircular chambers which communicate with the inlet openings of the housing. Disposed in mutually opposite relationship, outwardly of the heat transfer member, are first and second outlet diffuser chambers which increase in width from a narrow gap defined with the heat transfer member, towards the outlet portions of the respective chambers. The partitioning wall means is provided with a screening wall portion, at least one edge adjoining the inside surface of the rotary heat transfer member.

Thus, in that way, that region of the heat transfer member in which the incoming gaseous medium is transported by an entrainment effect of the rotary heat transfer member into the other flow of gaseous medium is screened or shielded so as to reduce the amount of mixing which can take place between the two flows. That also increases the level of efficiency of the apparatus.

In accordance with a preferred feature, the configuration of the screening or shielding wall portion substantially follows the internal contour of the heat transfer member, while the screening wall portion may occupy different positions with respect to the partitioning wall means. Preferably however, the screening wall portion extends from the edge of the partitioning wall means at which it is disposed, either in the direction of rotation of the heat transfer means or in the opposite direction to that direction of rotation. If screening wall portions are provided at both the edges of the partitioning wall means, then they both extend from their respective edges either in the direction of rotation of the heat transfer member or both in the opposite direction to the direction of rotation of the heat transfer member. However, it is also possible for one screening wall portion to extend in the direction of rotation of the heat transfer member and the other screening wall portion to extend in the opposite direction.

While the screening wall portion may be fitted onto the respective edge of the partitioning wall means, a simple construction provides that the screening wall portion is formed by a bent-over portion at the edge of the partitioning wall means. The length of the screening wall portion, in the peripheral direction of the rotary heat transfer member, depends on the nature of the gaseous media involved, the respective pressure conditions, and the speed of the heat transfer member. However, the length of the screening wall portion is generally in a range of from 3° to 30° and preferably from 10° to 15°. The height of the screening wall portion is equal to the height of the partitioning wall means.

In a further aspect of the present invention, an improvement in the efficiency of the rotary heat exchanger may be achieved by virtue of the partitioning wall means being of a heat-insulating construction. In addition, the heat-insulating construction of the partitioning wall means may also be a matter of significance, independently of the use of a screening wall portion on the partitioning wall means. In other words, the feature that the partitioning wall means has a screening wall portion and the feature that the partitioning wall means is of a heat-insulating nature may be used separately from each other or in combination with each other. Particularly in the case of flows of gaseous media with a substantial temperature difference therebetween, for example when the heat exchanger is operated with very low outside temperatures of −40° C. and an inside temperature of +20° C., the transfer of heat through the partitioning wall means is at a high level if the partitioning wall means comprises for example, in the usual manner, steel sheet or another material with a high level of thermal conductivity. There is also the risk that the moisture in the warm flow of air or gaseous medium may condense on the cold partitioning wall means and may even freeze, thereby giving rise to serious problems in operation of the heat exchanger.

Desirably, the partitioning wall means may be made of a heat-insulating construction by the partitioning wall means which comprises for example metal being coated at least on one side, preferably the cold side, with heat-insulating material. Such material may be for example a foam.

In another aspect of the invention, the practical possibilities of use of a heat exchanger may be further enlarged and enhanced by the heat exchanger itself being combined with a double fan or blower which is connected in parallel relationship with the heat exchanger on the intake and outlet sides, wherein flow control means such as control flaps may be provided for switching the arrangement between a heat exchange mode and a pure fan blowing mode. The flow control flaps may be disposed in the flows of gaseous media through the heat exchanger and the double fan assembly, on the intake and/or outlet sides. If for example the temperature difference between a feed air flow and an exhaust air flow is low, then heat exchange will advantageously be effected at a higher level of efficiency, when operating with the fan. In other cases it may also be desirable not to provide for any heat exchange between a feed flow and an exhaust flow, during certain periods of time, for example if the interior of a building or the like has become excessively warm in winter.

It should be appreciated at this point that the feature of a combination of rotary heat exchanger and double fan, as just referred to above, may be employed with or without the incorporation of the above-mentioned screening wall portion on the partitioning wall means and with or without the partitioning wall means being of a heat-insulating configuration.

There are a number of options in regard to a practical design of the heat exchanger-fan assembly: thus for example the annular heat transfer member of the heat exchanger and the rotor of the fan which is in the form of a radial flow fan may be disposed on the same shaft of a drive motor, with a stationary partitioning wall which subdivides the space inside the rotor into two semicircular chambers. The radial flow fan is then therefore of an entirely similar configuration to the heat exchanger itself, but instead of the annular heat transfer member it has an annular vane-bearing member of the usual kind in such fans. In an advantageous embodiment, the annular heat transfer member and the rotor of the radial flow fan may be disposed in back-to-back relationship on the shaft of the drive motor and may be of substantially the same outside diameters, while the housing of the heat exchanger and the housing of the radial flow fan may be of the same shape, with their outlet diffuser chambers, and may lie against each other in mutually aligned relationship. That provides a particularly simple and straightforward mechanical construction, while in addition the combination of the heat exchanger and the fan enjoys the same external appearance as a single housing. If the heat transfer member of the heat exchanger and the rotor of the fan rotate at the same speeds (being arranged on the same shaft), the structural height of the radial fan may be less than that of the heat exchanger because the level of efficiency of the radial flow fan is improved, in regard to the air conveying effect.

Further objects, features and advantages of the present invention will be more clearly apparent from the following description of preferred embodiments thereof.

BRIEF DESCRIPTION OF THE DRAWINGS

FIG. 1 is a diagrammatic view of an embodiment of a rotary heat exchanger according to the invention, FIGS. 2*a*–2*e* show a number of embodiments of the partitioning wall of the heat exchanger shown in FIG. 1, and FIGS. 3 and 4 are a side view and a front view respectively of a combination assembly of a heat exchanger and a radial flow fan, as an embodiment of the invention.

DESCRIPTION OF PREFERRED EMBODIMENTS

Figure 3:
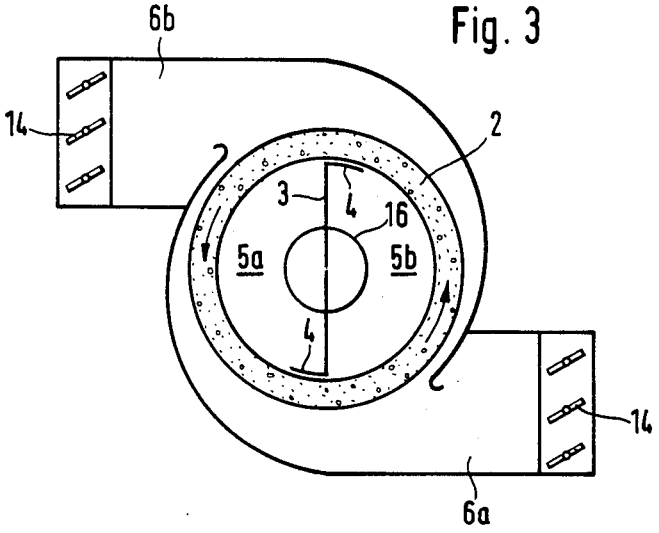

Referring firstly to FIG. 1, shown therein is a first embodiment of a heat exchanger comprising a housing which is indicated generally and diagrammatically by reference numeral 1. Disposed rotatably in the housing 1 is an annular rotary heat transfer member 2 which comprises for example open-pore foam and which is held in a lattice-like rotor (not shown) which is fixed on the shaft of a drive motor (not shown). Disposed in the interior of the heat transfer member 2 is a partitioning wall 3 which is stationary, that is to say, which does not rotate with the heat transfer member but is substantially stationary with respect to the housing 1. It should be noted however that, if appropriate, the partitioning wall 3 may be adjustable in regard to its annular position relative to the housing 1. It will be noted that the partitioning member 3 extends substantially across a diameter of the heat transfer member 2 and thus has first and second edges which are closely adjacent to the inside surface of the heat transfer member 2. Disposed at at least one such edge of the partitioning wall 3 is a screening or shielding wall portion 4 which forms a so-called purge section and, as illustrated, is in the form of a bent-over portion of the edge of the partitioning wall 3. The screening wall portion 4 substantially follows the circular internal contour of the surface of the heat transfer member 2. It will be seen from FIG. 1 that the partitioning wall 3 subdivides the interior of the heat transfer member 2 into two semicircular chambers 5*a* and 5*b* which communicate with inlet openings or ports provided by the housing of the heat exchanger, by way of suitable ducts (not shown).

When the heat transfer member 2 is caused to rotate in the direction indicated by the arrows illustrated thereon, air or other gaseous medium is conveyed from the chamber 5*a* defined within the heat transfer member 2 into an outlet diffuser or scroll chamber 6*a*, as shown in diagrammatic form by the small empty circles 7*a*. As can be clearly seen from FIG. 1, the outlet diffuser chamber 6*a* increases in width from a narrow gap defined with the heat transfer member 2, towards the actual outlet of the diffuser chamber 6*a*, so that the diffuser chamber 6*a* thus increases in width in a spiral-like configuration in an outward direction in relation to the air flow therethrough. Correspondingly, air is conveyed out of the chamber 5*b* defined within the heat transfer member 2 into a similar outlet diffuser chamber 6*b*, as shown by the small solid circles indicated at 7*b*. It will be seen that the first and second diffuser chambers 6*a* and 6*b* are disposed in mutually opposite relationship outside the heat transfer member 2.

In the region of the edges of the partitioning wall 3, due to particles of air or other gaseous medium being entrained in the heat transfer member 2, there could be a mixing or cross-over effect as between the two gaseous media flows which are in heat-exchange relationship with each other, in other words, certain parts of the air flow 7*a* are not discharged into the diffuser chamber 6*a* but are entrained by the heat transfer member and are conveyed into the diffuser chamber 6*b* where they mix with the air 7*b* coming from the inlet chamber 5*b*. A minimum degree of such mixing may be achieved by correct angular adjustment of the partitioning wall 3 with respect to the edges 8*a* and 8*b* of the housing, such edges forming a narrow gap with the heat transfer member 2. However, a substantial improvement in regard to minimising mixing of the flows of gaseous media in the above-indicated fashion is achieved by virtue of the screening wall portion which, in the critical mixing area 9 of the heat transfer member 2, as shown by the lines illustrated thereon at that point, prevents an inflow of air from the chamber 5*a*.

Depending on the respective position of the partitioning wall 3 and in dependence on the speed of rotation of the heat transfer member 2 and the respective media being conveyed through the apparatus, the screening wall portion 4 may extend from the edge of the partitioning wall 3 in the direction of rotation of the heat transfer member 2 or in the opposite direction thereto. In the embodiment illustrated in FIG. 1, the screening wall portion 4 extends in the opposite direction to the direction of rotation of the heat transfer member 2.

Reference will now be made to FIG. 2 showing further possible ways of arranging and designing the screening wall portions. In FIG. 2*a*, the screening wall portion 4*a* on the partitioning wall 3 extends in the same direction as the direction of rotation of the heat transfer member 2 in FIG. 1. In the constructions shown in FIGS. 2*b* and 2*c*, the respective partitioning wall 3 has two screening wall portions 4*b* and 4*c* respectively, which in FIG. 2*b* extend in the same direction as the direction of rotation of the heat transfer member 2 in FIG. 1, while in FIG. 2*c* the screening wall portions 4*c* extend in the opposite direction to the direction of rotation. In FIG. 2*d*, there are two screening wall portions 4*b* and 4*c* of which the former extends in the direction of rotation of the heat transfer member and the other wall portion 4*c* extends in the opposite direction.

Particularly in a situation where the temperature difference between for example a feed air flow which is to be conveyed from the chamber 5*a* into the chamber 6*a*, and an exhaust air flow which passes from the chamber 5*b* into the chamber 6*b* is very great, high heat losses may occur if the partitioning wall 3 (and therewith also the screening wall portion or portions 4) comprise a material with a high degree of thermal conductivity. An improvement in that respect may be achieved in the manner shown in FIG. 2*e*, in that the partitioning wall 3 and the screening wall portion 4 are coated with a layer 10 of heat-insulating material. The layer 10 desirably comprises a foam, for example a polyurethane foam. It will be appreciated that other ways of making the partitioning wall 3 a poor conductor of heat to minimise heat losses across the partitioning wall may also be employed. It should further be noted that the feature that the partitioning wall 3 is of a heat-insulating construction may be used separately from or in conjunction with the provision of one or more screening wall portions 4.

Figure 4:
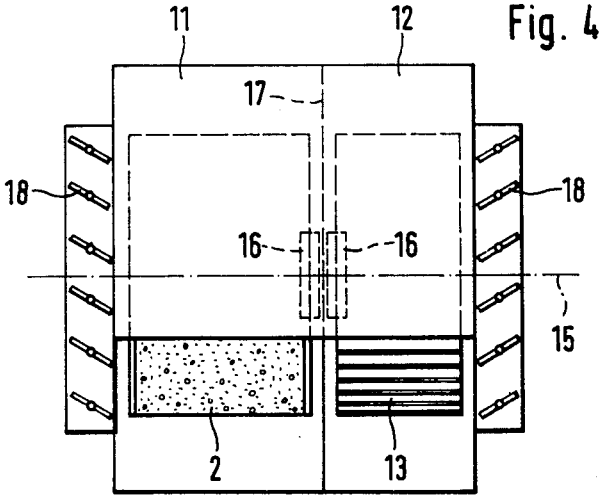

Reference will now be made to FIGS. 3 and 4 illustrating a combination assembly comprising a heat exchanger in accordance with that shown in FIG. 1, as indicated at 11 in FIG. 4, and a radial flow fan or blower as indicated at 12 in FIG. 4, which is of substantially the same configuration as the heat exchanger 11 but which has a vane-bearing wheel or annular rotor 13 of the usual kind, instead of the heat transfer member 2. In the rotor 13 also, a partitioning wall (not visible in FIG. 4) divides the interior thereof into two semicircular chambers.

In the side view shown in FIG. 3, parts of the housing have been removed in order more clearly to show the internal structure. It will be seen therefore that, in a similar manner to the construction shown in FIG. 1, the assembly of FIGS. 3 and 4 comprises a rotary heat transfer member 2, a partitioning wall 3 with screening wall portions 4 therewithin, the two internal chambers 5*a* and 5*b* and the associated diffuser chambers 6*a* and 6*b*. Disposed at the outlets of the chamers 6*a* and 6*b* are flow control means illustrated in the form of control flaps or shutters 14, by means of which the outlets may be opened or closed as required.

In accordance with the front view of FIG. 4, the annular heat transfer member 2 and the vaned rotor 13 of the fan 12 are disposed in back-to-back relationship on a common shaft 15 which is only shown in diagrammatic form, of a drive motor, by means of bearings 16 which are also only shown in diagrammatic form. The outlet diffuser chambers of the fan 12 are of the same form as the chambers 6*a* and 6*b* of the heat exchanger 11 so that overall it is possible to provide a compact unit which has only one partitioning wall 17 between the heat exchanger unit 11 and the fan unit 12. Control flaps or shutters 18 in the intake of the heat exchanger 11 and the fan 12 respectively, together with the flaps or shutters 14, permit the assembly to be switched over between a heat exchange mode and a pure fan blowing mode. Once again, the feature of the fan 12 being provided in combination with the heat transfer member 2 may be used with or without the provision of the one or more screening wall portions 4 and with or without the partitioning wall 3 being of a heat-insulating nature.

It should be noted in regard to the or each screening wall portion 4 that it may extend over a suitable angular range of for example from 3° to 30°, preferably from 10° to 15°, relative to the periphery of the heat transfer member 2. Furthermore, the flow control means formed by the flaps or shutters 14, 18 illustrated in FIGS. 3 and 4 may be disposed on the intake and/or the outlet side of the arrangement.

It will be appreciated that the above-described embodiments of the heat exchange assembly according to the invention were described by way of example of the invention and that various modifications and alterations may be made therein without departing from the scope of the invention.

What is claimed is:

1. A rotary heat exchanger for heat exchange between at least two gaseous media, said rotary heat exchanger comprising: a housing having first and second inlet openings; an annular heat transfer member disposed rotatably in said housing, said heat transfer member comprising a fiber material having a three dimensional lattice structure for flow communication and an interior cavity; a partitioning wall means for dividing said interior cavity of each said heat transfer member into two simicircular chambers, said first and second inlet openings of said housing communicating with a respective one of said two semicircular chambers, said partitioning wall means having a pair of edges and a screening wall extending from each of said pair of edges only in a direction opposite to the direction of rotation of said heat transfer member and adjacent to said annular heat transfer member; and first and second outlet diffuser chambers disposed in a substantially mutually opposite relationship external to said heat transfer member, each of said outlet diffuser chambers having an outlet and increasing in width from adjacent said heat transfer member towards said outlet of said outlet diffuser chambers wherein said partitioning wall means is coated with a heat insulating material.

2. A heat exchanger as set forth in claim 1 wherein the configuration of said screening wall substantially matches said contour of said interior cavity of said heat transfer member.

3. A heat exchanger as set forth in claim 1 wherein said screening wall comprises a bent portion of said partitioning wall means.

4. A heat exchanger as set forth in claim 1 wherein said screening wall extends over an angular range of from 3° to 30° of said heat transfer member.

5. A heat exchanger as set forth in claim 4 wherein said angular range is from 10° to 15°.

* * * * *